US006284004B1

(12) United States Patent
Burglin et al.

(10) Patent No.: US 6,284,004 B1
(45) Date of Patent: Sep. 4, 2001

(54) PROCESS FOR INK-JET PRINTING TEXTILE FIBRE MATERIALS

(75) Inventors: Marc Burglin, Battenheim; Mickael Mheidle, Sausheim, both of (FR); Peter Scheibli, Bottmingen (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 09/577,289

(22) Filed: May 23, 2000

Related U.S. Application Data

(63) Continuation of application No. 09/211,828, filed on Dec. 15, 1998, now abandoned.

(30) Foreign Application Priority Data

Dec. 17, 1997 (EP) ..... 97810995

(51) Int. Cl.[7] ..... D06P 1/18; D06P 1/20; D06P 1/52; D06P 1/66

(52) U.S. Cl. ..... 8/466; 8/445; 8/558; 8/606; 8/662; 8/597; 8/675; 8/677; 106/31.27

(58) Field of Search ..... 8/445, 466, 552, 8/551, 557, 558, 662, 589, 597, 606, 675, 677; 106/31.27

(56) References Cited

U.S. PATENT DOCUMENTS

| | | | | |
|---|---|---|---|---|
| 4,202,838 | | 5/1980 | Lauton et al. | 260/505 |
| 4,297,100 | | 10/1981 | Koci et al. | 8/527 |
| 4,648,905 | * | 3/1987 | Peck et al. . | |
| 5,074,887 | | 12/1991 | Koci | 8/527 |
| 5,563,644 | * | 10/1996 | Isganitis et al. . | |
| 5,631,309 | * | 5/1997 | Yanagi et al. . | |
| 5,658,376 | * | 8/1997 | Noguchi et al. . | |
| 5,662,734 | * | 9/1997 | Crystal . | |
| 5,782,965 | | 7/1998 | Ishida et al. | 106/31.33 |
| 5,888,253 | * | 3/1999 | Yamamoto et al. . | |

FOREIGN PATENT DOCUMENTS

| | | | |
|---|---|---|---|
| 0655527 | | 5/1995 | (EP) . |
| 0711867 | | 5/1996 | (EP) . |
| 0805230 | | 11/1997 | (EP) . |
| 6240194 | | 8/1994 | (JP) . |
| 10-279869 | * | 10/1998 | (JP) . |

OTHER PUBLICATIONS

Derwent Abstr. 93–348635 of JP 05 255 626 (10/93).

Patent Abstracts of Japan No. 62011780 (1/87).

* cited by examiner

*Primary Examiner*—Margaret Einsmann
(74) *Attorney, Agent, or Firm*—Kevin T. Mansfield

(57) ABSTRACT

The invention relates to a process for printing textile fibre materials by the ink-jet printing process, wherein the fibre materials are printed with an aqueous ink comprising at least one disperse dye, an anionic copolymer and/or a nonionic block polymer and/or a dispersant, and to the inks comprising these components.

11 Claims, No Drawings

PROCESS FOR INK-JET PRINTING TEXTILE FIBRE MATERIALS

This is a continuation of application Ser. No. 09/211,828, now abandoned filed on Dec. 15, 1998.

The present invention relates to a process for printing textile fibre materials with disperse dyes by the ink-jet printing process (et and inkjet processes) and to corresponding printing inks.

Ink-jet printing processes have already been used for some years in the textile industry. They make it possible to do without the otherwise customary production of a printing stencil, so enabling considerable savings to be made in both cost and time. In connection with the production of originals, in particular, it is possible to respond to changes within a much shorter time.

Appropriate ink-jet printing processes should in particular have optimum performance characteristics. In this context mention may be made of characteristics such as viscosity, stability, surface tension and conductivity of the inks that are used. In addition, heightened requirements are placed on the quality of the resulting prints, in terms, for example, of colour strength, fibre-dye bond stability, and wet fastness properties. The known processes do not meet these requirements in every characteristic, so that there continues to be a need for new processes for textile ink-jet printing.

The present invention provides a process for printing textile fibre materials by the ink-jet printing proicess, wherein the fibre materials are printed with an aqueous ink comprising at least one disperse dye, an anionic copolymer and/or a nonionic block polymer and/or a dispersant.

Suitable disperse dyes for the process of the invention are those described under "Disperse Dyes" in the Colour Index, 3rd edition (3rd Revision 1987 including additions and amendments up to No. 85). Examples are carboxyl- and/or sulfo-free nitro, amino, amino ketone, ketone imine, methine, polymethine, diphenylamine, quinoline, benzimidazole, xanthene, oxazine or coumarin dyes, and especially anthraquinone dyes and azo dyes, such as monoazo or disazo dyes.

In the process of the invention it is preferred to use disperse dyes of the formulae (1)

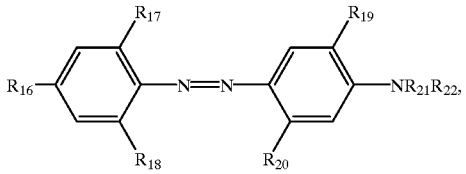

in which $R_{16}$ is halogen, nitro or cyano, $R_{17}$ is hydrogen, halogen, nitro or cyano, $R_{18}$ is halogen or cyano, $R_{19}$ is hydrogen, halogen, $C_1$–$C_4$alkyl or $C_1$–$C_4$alkoxy, $R_{20}$ is hydrogen, halogen or acylamino, and $R_{21}$ and $R_{22}$ independently of one another are hydrogen or are $C_1$–$C_4$alkyl which is unsubstituted or substituted by hydroxyl, cyano, acetoxy or phenoxy, (2)

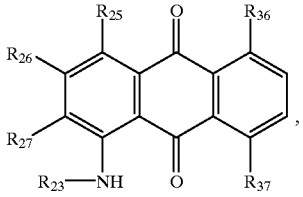

in which $R_{23}$ is hydrogen, phenyl or phenylsulfoxy, the benzene ring in phenyl and phenylsulfoxy being unsubstituted or substituted by $C_1$–$C_4$alkyl, sulfo or $C_1$–$C_4$alkylsulfo, $R_{25}$ is unsubstituted or $C_1$–$C_4$ alkyl-substituted amino or hydroxyl, $R_{26}$ is hydrogen or $C_1$–$C_4$alkoxy, $R_{27}$ is hydrogen or the radical —O—$C_6H_5$—$SO_2$—NH—$(CH_2)_3$—O—$C_2H_5$, $R_{36}$ is hydrogen, hydroxyl or nitro and $R_{37}$ is hydrogen, hydroxyl or nitro, (3)

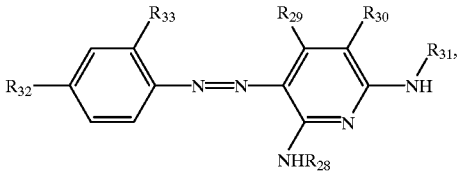

in which $R_{28}$ is $C_1$–$C_4$alkyl which is unsubstituted or substituted by hydroxyl, $R_{29}$ is $C_1$–$C_4$alkyl, $R_{30}$ is cyano, $R_{31}$ is the radical of the formula —$(CH_2)_3$—O—$(CH_2)_2$—O—$C_6H_5$, $R_{32}$ is halogen, nitro or cyano, and $R_{33}$ is hydrogen, halogen, nitro or cyano, (4)

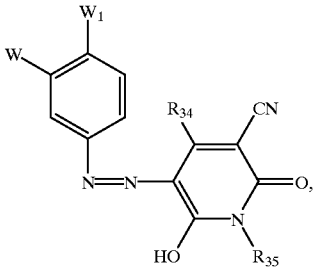

in which $R_{34}$ is $C_1$–$C_4$alkyl, $R_{35}$ is $C_1$–$C_4$alkyl which is unsubstituted or substituted by $C_1$–$C_4$alkoxy and W is the radical —$COOCH_2CH_2OC_6H_5$ and $W_1$ is hydrogen or W is hydrogen and $W_1$ is —N=N—$C_6H_5$, (5)

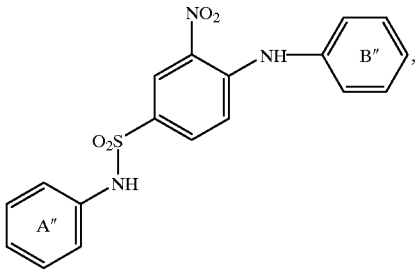

where the rings A" and B" are unsubstituted or substituted one or more times by halogen, (6)

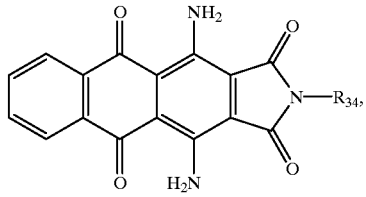

in which $R_{34}$ is $C_1$–$C_4$alkyl, which is unsubstituted or substituted by hydroxyl, $C_1$–$C_4$alkoxy or $C_1$–$C_4$-alkoxy-$C_1$–$C_4$alkoxy, and (7)

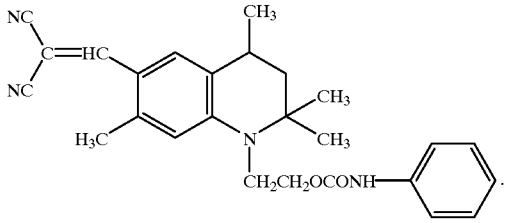

In the process of the invention, particular preference is given to using the dyes of the formulae (8)

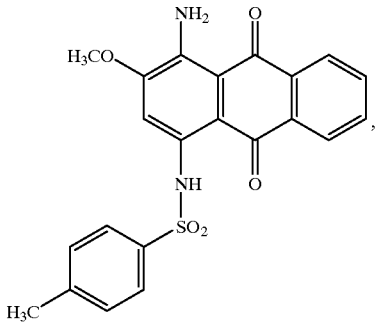

(9)

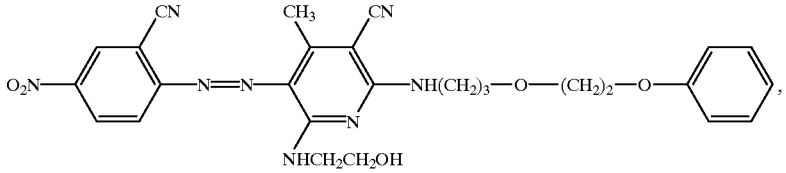

(10)

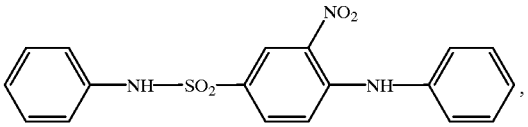

-continued
(11)
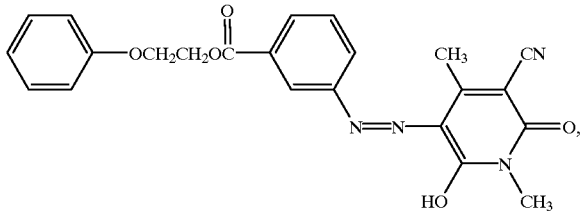
(12)
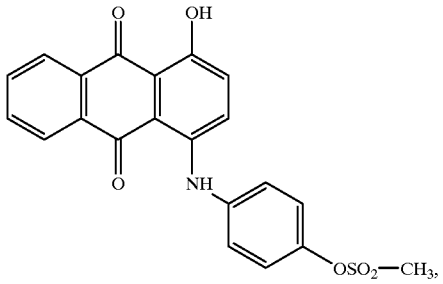
(13)
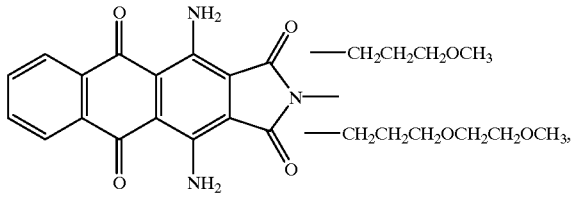
(14)
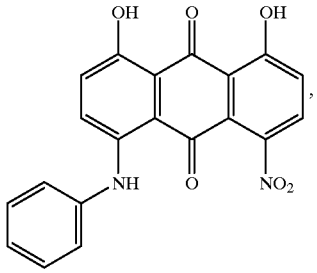
(15)
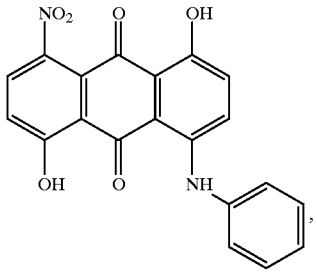
(16)
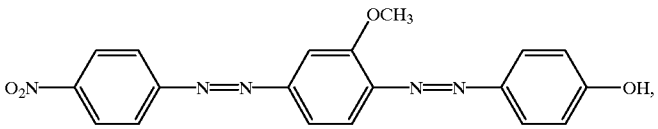
(17)
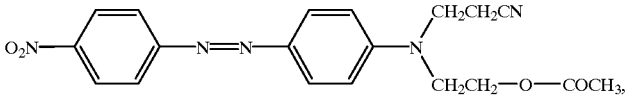

-continued (18)

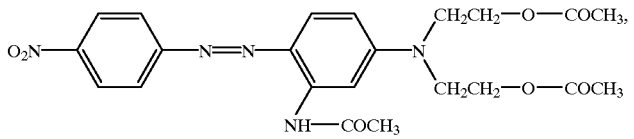

(19)

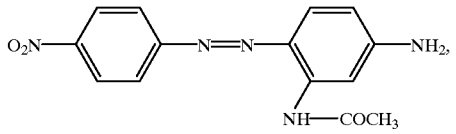

(20)

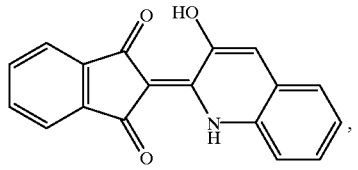

(21)

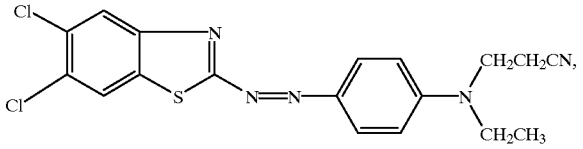

(22)

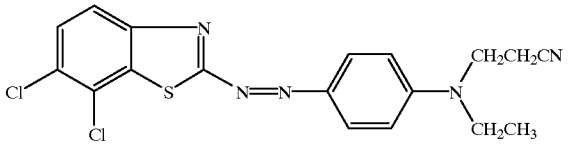

and (23)

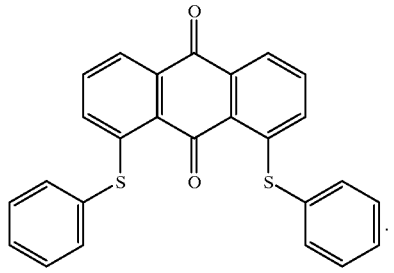

The disperse dyes of the formulae (1) to (23) are known or can be prepared in analogy to known compounds by known standard techniques, such as by customary diazotization, coupling, addition and condensation reactions.

The inks generally have an overall content of disperse dyes of the above formulae (1) to (23) of from 1 to 35% by weight, in particular from 1 to 20% by weight and, above all, from 1 to 10% by weight, based on the overall weight of the ink.

Within the inks of the invention the disperse dyes are advantageously in a finely dispersed form. For this purpose the disperse dyes are milled to an average particle size of between 0.1 and 10 microns, preferably between 1 and 5 microns and, with particular preference, between 0.5 and 2 microns. Milling can be carried out in the presence of dispersants. For example, the dried disperse dye is milled with a dispersant or kneaded in paste form with a dispersant and, if desired, is dried under reduced pressure or by spraying. The resulting preparations can be used to prepare the inks of the invention by addition of water and, if desired, of further auxiliaries.

Copolymers which are suitable as the anionic copolymer for the process of the invention are, in particular, those based on acrylic, methacrylic or maleic acid. Among these, preference is given to those obtainable by polymerization of acrylic and/or methacrylic acid and one or more copolymerizable monomers selected from the group consisting of maleic acid, N-vinylformamide, N-vinylacetamide, allylamine and diallylamine derivatives, N-vinyl-pyrrolidone, N-vinyl-N-methylformamide, N-vinyl-N-methylacetamide, N-vinyl-N-ethylacetamide, vinyl acetate, vinyl propionate, acrylonitrile, styrene, methacrylonitrile, acrylamide, methacrylamide and N-mono/N,N-di-$C_1$–$C_{10}$ alkyl(meth) acrylamide.

Particularly preferred anionic copolymers are those obtainable by copolymerization of acrylic or methacrylic acid and styrene.

Very particular preference is given to acrylic and methacrylic acid-styrene copolymers having a molecular weight of from 3000 to 16 000, in particular from 3000 to 10 000.

Suitable nonionic block polymers for the process of the invention are, in particular, alkylene oxide condensates, such as adducts of ethylene oxide with polypropylene oxide (known as EO-PO block polymers) and adducts of propylene oxide with polyethylene oxide (known as reverse EO-PO block polymers), and block polymers obtainable by adding styrene onto polypropylene oxide and/or polyethylene oxide.

Preference is given to ethylene-propylene oxide block polymers having molecular weights of between 2000 and 20 000, in particular between 8000 and 16 000, and an ethylene oxide content in the total molecule of from 30 to 80%, in particular from 60 to 80%.

Particularly suitable dispersants are anionic dispersants from the group consisting of (ba) acidic esters or their salts of alkylene oxide adducts of the formula (24)

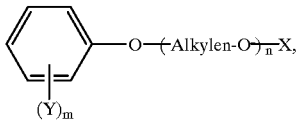

in which

X is the acid radical of an inorganic, oxygen-containing acid, such as sulfuric or, preferably, phosphoric acid, or else the radical of an organic acid, Y is $C_1$–$Cl_2$alkyl, aryl or aralkyl, "Alkylen" is the ethylene radical or propylene radical, and m is from 1 to 4 and n is from 4 to 50, (bb) polystyrenesulfonates, (bc) fatty acid taurides, (bd) alkylated diphenyl oxide mono- or disulfonates, (be) sulfonates of polycarboxylic esters, (bf) an adduct of from 1 to 60, preferably from 2 to 30, mol of ethylene oxide and/or propylene oxide with fatty amines, fatty amides, fatty acids or fatty alcohols each having 8 to 22 carbon atoms or with trihydric to hexahydric alkanols having 3 to 6 carbon atoms, the said adduct being converted into an acidic ester with an organic dicarboxylic acid or with an inorganic polybasic acid, (bg) ligninsulfonates, (bh) naphthalenesulfonates, and (bi) formaldehyde condensates.

As ligninsulfonates (bg) use is made primarily of those ligninsulfonates, or their alkali metal salts, whose content of sulfo groups does not exceed 25% by weight. Preferred ligninsulfonates are those having a content of from 5 to 15% by weight of sulfo groups. Examples of suitable formaldehyde condensates (bi) are condensates of ligninsulfonates and/or phenol and formaldehyde, condensates of formaldehyde with aromatic sulfonic acids, such as condensates of ditolyl ether sulfonates and formaldehyde, condensates of naphthalenesulfonic acid with formaldehyde and/or of naphthol- or naphthylaminosulfonic acids with formaldehyde, condensates of phenolsulfonic acids and/or sulfonated dihydroxydiphenyl sulfone and phenols or cresols with formaldehyde and/or urea, and condensates of diphenyl oxide disulfonic acid derivatives with formaldehyde. Preferred products (bi) are condensates of ditolyl ether sulfonates and formaldehyde, as described for example in U.S. Pat. No. 4,386,037, condensates of phenol and formaldehyde with ligninsulfonates, as described for example in U.S. Pat. No. 3,931,072, condensates of 2-naphthol-6-sulfonic acid, cresol, sodium bisulfite and formaldehyde [cf. FIAT Report 1013 (1946)], and condensates of diphenyl derivatives and formaldehyde, as described for example in U.S. Pat. No. 4,202,838.

A particularly preferred compound (bi) is the compound of the formula (25)

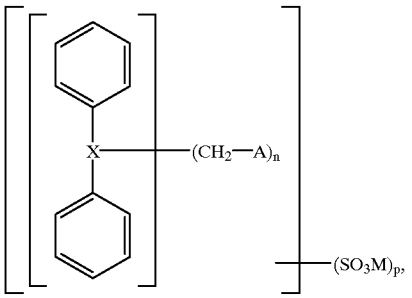

in which

X is a direct bond or oxygen,

A is the radical of an aromatic compound and is attached to the methylene group by a ring carbon atom, M is hydrogen or a salt-forming cation, such as an alkali metal, alkaline earth metal or ammonium, and n and p independently of one another are a number from 1 to 4.

A very particularly preferred compound (bi) is a compound based on the sulfonated condensate of a chloromethylbiphenyl isomer mixture and naphthalene, of the formula (26)

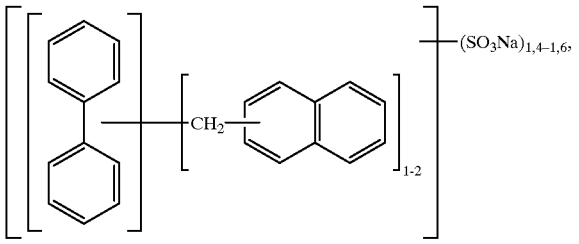

in which $(SO_3Na)_{1,4\text{-}1,6}$ denotes an average degree of sulfonation of from 1.4 to 1.6.

The above dispersants are known or can be prepared in analogy to known compounds by widely known processes.

The overall content of anionic copolymer, nonionic block polymer and dispersant in the ink of the invention is from 3 to 9% by weight based on the overall weight of the ink.

The ratio of anionic copolymer to nonionic block polymer to dispersant in the ready-to-use ink can vary widely; for example 1.5:0.5:1; 1:0.5:1.5; 1:1:1; 1:0:1; 1:1:0; 1:0:0; 0:1:1 or 0:0:1.

Preferred inks for the process of the invention are those comprising anionic copolymer and nonionic block polymer or anionic copolymer and dispersant or nonionic block polymer and dispersant.

Particularly preferred inks are those comprising anionic copolymer, nonionic block polymer and dispersant.

Apart from the disperse dyes of the formulae (1) to (23), the anionic copolymers, the non ionic block polymers and the dispersants, the ink may judiciously include thickeners of natural or synthetic origin, examples being commercial alginate thickeners, starch ethers or locust bean gum ethers, especially sodium alginate on its own or in a mixture with modified cellulose, in particular with preferably from 20 to 25 percent by weight of carboxymethyl-cellulose.

In the inks of the invention, p reference is given to the use of synthetic thickeners such as those based on poly(meth)a crylic acids or poty(meth)acrylamides.

For the process of the invention, preference is given to inks having a viscosity of from 1 to 40 mPa.s (millipascal seconds), in particular from 1 to 20 mPa.s and, above all, from 1 to 10 mPa.s.

Likewise preferred for the process of the invention are inks having a surface tension of between 60 and 30 newtons per centimeter (N/cm), in particular between 50 an d 40 N/cm.

Important inks for the process of the invention are those having a conductivity of from 0 to 3000 $\mu$S/cm, in particular from 100 to 700 $\mu$S/cm, based on a 10% aqueous suspension.

The inks may also include buffer substances, such as borax, borate or citrate. Examples are borax, sodium borate, sodium tetraborate, and sodium citrate. They are used in particular in amounts of from 0.1 to 3% by weight, especially from 0.1 to 1% by weight, based on the overall weight of the ink, so as to give a pH of, for example, from 4 to 10, preferably from 5 to 8.

Further additives which may be present in the inks are surfactants, redispersants and humectants.

Suitable surfactants are the customary commercial anionic or nonionic surfactants. Betaine monohydrate may be mentioned as an example of a redispersant. As the humectant it is preferred to use a mixture of sodium lactate (advantageously in the form of an aqueous solution with a strength of from 50 to 60%) and glycerol and/or propylene glycol in amounts of preferably from 7 to 20 percent by weight in the ink employed in accordance with the invention.

If desired, the inks may also include acid donors, such as butyrolactone or sodium hydrogen phosphate, preservatives, substances which inhibit bacterial and/or fungal growth, foam suppressants, sequestrants, emulsifiers, water-insoluble solvents, oxidizing agents, or degassing agents.

Suitable preservatives are, in particular, formaldehyde donors, such as paraformaldthyde and trioxane, especially aqueous solutions of formaldehyde with strengths of from about 30 to 40 percent by weight; suitable sequestrants are, for example, sodium nitrlotshacetate, sodium ethylenediaminetetraacetate and, in particular, sodium polymetaphosphate, especially sodium hexametaphosphate; suitable emulsifiers are, in particular, adducts of an alkylene oxide and a fatty alcohol, especially an adduct of oleyl alcohol and ethylene oxide; suitable water-insoluble solvents are high-boiling saturated hydrocarbons, especially paraffins having a boiling range from about 160 to 210° C. (known as paint and varnish maker's naphthas); a suitable oxidizing agent is, for example, an aromatic nitro compound, especially an aromatic mono- or dinitrocarboxylic or -sulfonic acid, which may be in the form of an alkylene oxide adduct, especially a nitrobenzenesulfonic acid; and suitable degassing agents are, for example, high-boiling solvents, especially turpentine oils, higher alcohols, preferably $C_8$ to $C_{10}$ alcohols, terpene alcohols or degassing agents based on mineral oils and/or silicone oils, especially commercial formulations composed of from about 15 to 25 percent by weight of a mineral and silicone oil mixture and from about 75 to 85 percent by weight of a $C_8$ alcohol such as 2-ethyl-n-hexanol, for example.

The inks can be prepared in customary manner by mixing the individual constituents in the desired amount of water.

The inks are preferably prepared, for example, by stirring one or more disperse dyes of the formulae (1) to (23) with a dispersant/copolymer/block polymer mixture and milling the resulting mixture in a wet mill to a defined degree of milling corresponding to an average particle size of from 0.2 to 1.0 $\mu$m. Subsequently, the concentrated millbase—with or without the use of, for example, appropriate thickeners, dispersants, copolymers, surfactants, humectants, redispersants, sequestrants and/or preservatives, and also water—is adjusted to the desired concentration. To remove any coarse fractions present it is possible with advantage to carry out filtration of the ready-to-use ink through a microsieve of about 1 $\mu$m.

The process of the invention for printing textile fibre materials can be implemented with ink-jet printers which are known per se and are suitable for textile printing.

In the ink-jet printing process, individual drops of the ink are sprayed from a nozzle onto the substrate in a controlled manner. The methods used in this context are predominantly the continuous ink-jet method and the drop-on-demand method. In the case of the continuous ink-jet method the drops are generated continuously, with the drops that are not required for printing being diverted into a collecting vessel and, in general, recycled. In the case of the drop-on-demand method, on the other hand, the drops are generated and used for printing when desired; in other words, drops are only generated when required for printing. Generation of the drops can be carried out advantageously, for example, by means of a piezoelectric ink-jet head or by means of thermal energy (referred to as bubble jet). For the process of the invention, preference is given to printing by the continuous ink-jet method or by the drop-on-demand method.

After printing, the fibre material is dried at temperatures of up to 150° C., preferably from 80° C. to 120° C.

The subsequent fixing of the fibre material takes place in general by means of dry heat (thermofixing) or by means of superheated steam under atmospheric pressure (HT fixing). Fixing is carried out under the following conditions:
Thermofixing: from 1 to 2 minutes at from 190 to 230° C.;
HT fixing: from 4 to 9 minutes at from 170 to 190° C.

The ink used in accordance with the invention can be applied to a variety of types of fibre material, such as wool, silk, cellulose, polyvinyl, polyacrylonitrile, polyamide, aramid, polypropylene, polyester or polyurethane.

Preference is given to polyester-containing fibre materials.

Suitable polyester-containing fibre materials are those consisting wholly or partly of polyester. Examples are cellulose ester fibres, such as secondary cellulose acetate and cellulose triacetate fibres, and especially linear polyester fibres with or without acid modification, which are obtained, for example, by condensation of terephthalic acid with ethylene glycol or of isophthalic acid or terephthalic acid with 1,4bis(hydroxymethyl)-cyclohexane, and also fibres made from copolymers of terephthalic and isophthalic acid with ethylene glycol. Suitability extends to polyester-containing mixed-fibre materials; in other words, to blends of polyester with other fibres.

The present invention additionally provides an aqueous printing ink for the ink-jet printing process, which ink comprises from 1 to 35% by weight of at least one disperse dye of the above formulae (1) to (23), an anionic copolymer and/or a nonionic block polymer and/or a dispersant.

The printing ink of the invention and the disperse dyes of the formulae (1) to (23), the anionic copolymers, the nonionic block polymers and the dispersants used in the ink are subject to the definitions and preferences indicated earlier above.

The prints obtainable by the process of the invention have good all-round fastness properties; for example, they possess high fibre-dye bond stability in both the acidic and the alkaline range, good light fastness, good wet fastness properties, such as water fastness, wash fastness, saltwater fastness, fastness to cross-dyeing and to perspiration, good chlorine fastness, rub fastness, ironing fastness and fastness to dry heat setting, and also well-defined contours and high colour strength. The printing inks used are notable for good stability and good viscosity characteristics.

The examples which follow serve to illustrate the invention. In these examples the temperatures are in degrees Celsius and parts and percentages are by weight unless specified otherwise. The relationship between parts by weight and parts by volume is that of the kilogram to the liter.

EXAMPLE 1

2.0 parts by weight of the disperse dye of the formula (10)

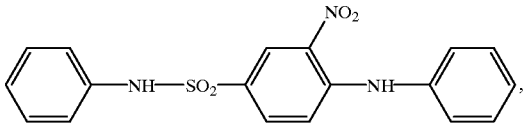

are stirred with 0.3 part by weight of a dispersant based on a sulfonated condensate of chloromethylbiphenyl isomer mixture and naphthalene and 3.0 parts by weight of an anionic copolymer of acrylic acid and styrene and the mixture is then milled in a wet mill to an average particle size of from 0.2 to 1.0 $\mu$m.

Thereafter the ink, by addition with thorough stirring of 1.0 part by weight of a commercial surfactant,
3.7 parts by weight of a commercial redispersant,
0.2 part by weight of a commercial preservative,
20.0 parts by weight of a commercial humectant and
69.8 parts by weight of water, is adjusted to a dye content of 2 percent by weight.

EXAMPLE 2

The ink prepared as in Example 1 is printed on a polyester fabric using an inkjet printer operating by the drop-on-demand piezo technique.

The print is dried and is fixed in superheated steam at 180° C. for 8 minutes.

The result is a bright yellow print having good all-round fastness properties, especially wetfastness and lightfastness.

A bright yellow print having good all-round fastness properties, especially wetfastness and lightfastness, is likewise obtained if the dried print is fixed with hot air at 200° C. for 1 minute.

EXAMPLE 3

3.0 parts by weight of the disperse dye of the formula (27)

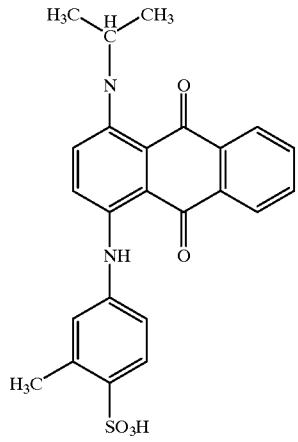

are stirred with 2.0 parts by weight of a dispersant based on a sulfonated condensate of chloromethylbiphenyl isomer mixture and naphthalene and 6.5 parts by weight of an anionic copolymer of acrylic acid and styrene (®Narlex DX2020 from National Starch & Chemical), and the mixture is then milled in a wet mill to an average particle size of from 0.2 to 1.0 $\mu$m.

Thereafter the ink, by addition with thorough stirring of 12.0 parts by weight of 85% glycerol,
5.0 parts by weight of diethylene glycol,
3.0 parts by weight of betaine monohydrate,
0.1 part by weight of N-hydroxymethylchloroacetamide and
68.4 parts by weight of water, is adjusted to a dye content of 3 percent by weight.

EXAMPLE 4

The ink prepared as in Example 3 is printed on a polyester fabric using an inkjet printer operating by the drop-on-demand piezo technique.

The print is dried and is fixed in superheated steam at 180° C. for 8 minutes.

The result is a blue print having good all-round fastness properties, especially wetfastness and lightfastness.

A blue print having good all-round fastness properties, especially wetfastness and lightfastness, is likewise obtained if the dried print is fixed with hot air at 200° C. for 1 minute.

EXAMPLE 5

2.0 parts by weight of the disperse dye of the formula (28)

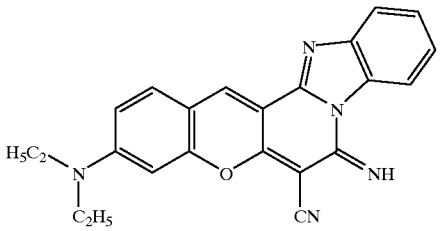

are stirred with 1.0 part by weight of a dispersant based on a sulfonated condensate of chloromethylbiphenyl isomer mixture and naphthalene and 0.3 part by weight of an nonionic alkylene oxide block polymer (®Pluronic F108 from Albright & Wilson), and the mixture is then milled in a wet mill to an average particle size of from 0.2 to 1.0 μm.

Thereafter the ink, by addition with thorough stirring of 12.0 parts by weight of 85% glycerol,
5.0 parts by weight of diethylene glycol,
3.0 parts by weight of betaine monohydrate,
0.1 part by weight of N-hydroxymethylchloroacetamide and
76.6 parts by weight of water, is adjusted to a dye content of 2 percent by weight.

EXAMPLE 6

The ink prepared in Example 5 is printed on a polyester fabric using an inkjet printer operating by the drop-on-demand piezo technique.

The print is dried and is fixed in superheated steam at 180° C. for 8 minutes.

The result is a blue print having good all-round fastness properties, especially wetfastness and lightfastness.

A blue print having good all-round fastness properties, especially wetfastness and lightfastness, is likewise obtained if the dried print is fixed with hot air at 200° C. for 1 minute.

EXAMPLE 7

1.2 parts by weight of the disperse dye of the formula (29)

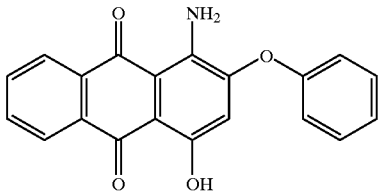

and 2.2 parts by weight of the disperse dye of the formula (30)

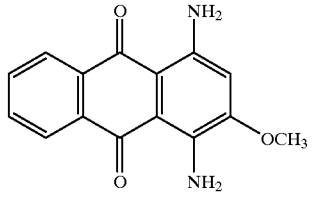

are stirred with 1.0 part by weight of a dispersant based on a sulfonated condensate of chloromethylbiphenyl isomer mixture and naphthalene and the mixture is then milled in a wet mill to an average particle size of from 0.2 to 1.0 μm.

Thereafter the ink, by addition with thorough stirring of 12.0 parts by weight of 85% glycerol,
5.0 parts by weight of diethylene glycol,
3.0 parts by weight of betaine monohydrate,
0.1 part by weight of N-hydroxymethylchloroacetamide and
75.5 parts by weight of water, is adjusted to a dye content of 3.4 percent by weight.

EXAMPLE 8

The ink prepared in Example 7 is printed on a polyester fabric using an inkjet printer operating by the drop-on-demand piezo technique.

The print is dried and is fixed in superheated steam at 180° C. for 8 minutes.

The result is a pink print having good all-round fastness properties, especially wetfastness and lightfastness.

A pink print having good all-round fastness properties, especially wetfastness and lightfastness, is likewise obtained if the dried print is fixed with hot air at 200° C. for 1 minute.

EXAMPLE 9

4.0 parts by weight of the disperse dye of the formula (31)

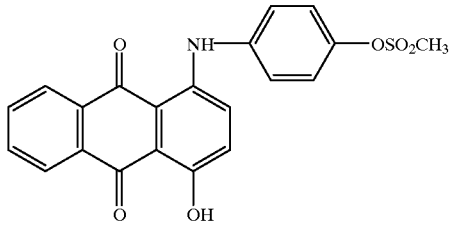

are stirred with 2.0 parts by weight of a dispersant based on a sulfonated condensate of chloromethylbiphenyl isomer mixture and naphthalene and 1.0 part by weight of an nonionic alkylene oxide block polymer (®Pluronic F108 from Albright & Wilson), and 8.0 parts by weight of an anionic copolymer of acrylic acid and styrene (®Narlex DX2020 from National Starch & Chemical), and the mixture is then milled in a wet mill to an average particle size of from 0.2 to 1.0 μm.

Thereafter the ink, by addition with thorough stirring of 5.0 parts by weight of 85% glycerol,
15.0 parts by weight of diethylene glycol, 2.0 parts by weight of betaine monohydrate,
0.1 part by weight of N-hydroxymethylchloroacetamide and
62.9 parts by weight of water,
is adjusted to a dye content of 2 percent by weight.

EXAMPLE 10

The ink prepared in Example 9 is printed on a polyester fabric using an inkjet printer operating by the drop-on-demand piezo technique.

The print is dried and is fixed in superheated steam at 180° C. for 8 minutes.

The result is a violet print having good all-round fastness properties, especially wetfastness and lightfastness.

A violet print having good all-round fastness properties, especially wetfastness and lightfastness, is likewise obtained if the dried print is fixed with hot air at 200° C. for 1 minute.

EXAMPLE 11

4.0 parts by weight of the disperse dye of the formula (32)

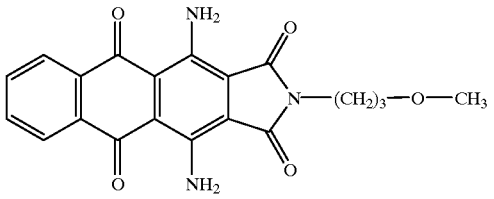

are stirred with 1.0 part by weight of a dispersant based on a sulfonated condensate of chloromethylbiphenyl isomer mixture and naphthalene and 3.0 parts by weight of an anionic copolymer based on a partially sulfated octylphenol ethoxylate with 25 ethylene oxide units per mole of octylphenol (®Emulphor OPS 25 from BASF), and the mixture is then milled in a wet mill to an average particle size of from 0.2 to 1.0 $\mu$m.

Thereafter the ink, by addition with thorough stirring of
10.0 parts by weight of 85% glycerol,
10.0 parts by weight of diethylene glycol,
1.7 parts by weight of betaine monohydrate,
0.1 part by weight of N-hydroxymethylchloroacetamide and
70.2 parts by weight of water,
is adjusted to a dye content of 2 percent by weight.

EXAMPLE 12

The ink prepared in Example 11 is printed on a polyester fabric using an inkjet printer operating by the drop-on-demand piezo technique.

The print is dried and is fixed in superheated steam at 180° C. for 8 minutes.

The result is a blue print having good all-round fastness properties, especially wetfastness and lightfastness.

A blue print having good all-round fastness properties, especially wetfastness and lightfastness, is likewise obtained if the dried print is fixed with hot air at 200° C. for 1 minute.

Prints having good all-round fastness properties, especially wetfastness and lightfastness, are likewise obtained if the inks prepared in accordance with Examples 1, 3, 5, 7, 9 and 11 are printed onto a polyester fabric using an inkjet printer operating by the drop-on-demand bubble jet technique and are finished as indicated above.

If the inks prepared according to Examples 1, 3, 5, 7, 9 and 11 are printed onto a polyester fabric by a continuous ink-jet method and finished as indicated above, the result is again prints having good all-round fastness properties, especially wetfastness and lightfastness.

What is claimed is:

1. A process for printing textile fibre materials by the ink-jet printing process, wherein the materials are printed with an aqueous ink comprising at least one disperse dye of the formula (1)

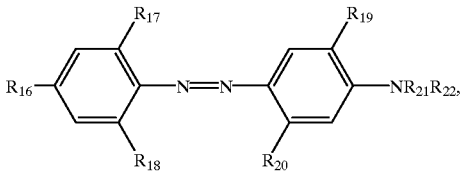

in which $R_{16}$ is halogen, nitro or cyano, $R_{17}$ is hydrogen, halogen, nitro or cyano, $R_{18}$ is halogen or cyano, $R_{19}$ is hydrogen, halogen $C_1$–$C_4$alkyl or $C_1$–$C_4$alkoxy, $R_{20}$ is hydrogen, halogen or acylamino, and $R_{21}$ and $R_{22}$ independently of one another are hydrogen or are $C_1$–$C_4$alkyl which is unsubstituted or substituted by hydroxyl, cyano, acetoxy or phenoxy, (2)

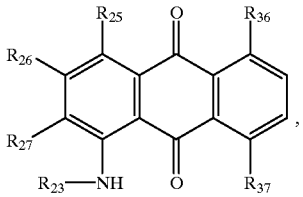

in which $R_{23}$ is hydrogen, phenyl or phenylsulfoxy, the benzene ring in phenyl and phenylsulfoxy being unsubstituted or substituted by $C_1$–$C_4$alkyl, sulfo or $C_1$–$C_4$alkylsulfo, $R_{25}$ is unsubstituted or $C_1$–$C_4$alkyl substituted amino or hydroxyl, $R_{26}$ is hydrogen or $C_1$–$C_4$alkoxy, $R_{27}$ is hydrogen or the radical —O—$C_6H_5$—$SO_2$—NH—$(CH_2)_3$—O—$C_2H_5$, $R_{36}$ is hydrogen, hydroxyl or nitro and $R_{37}$ is hydrogen, hydroxyl or nitro, (3)

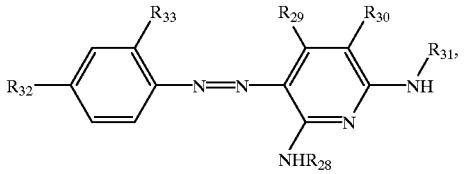

in which $R_{28}$ is $C_1$–$C_4$alkyl which is unsubstituted or substituted by hydroxyl, $R_{29}$ is $C_1$–$C_4$alkyl, $R_{30}$ is cyano, $R_{31}$ is the radical of the formula —$(CH_2)_3$—O—$(CH_2)_2$—O—$C_6H_5$, $R_{32}$ is halogen, nitro or cyano, and $R_{33}$ is hydrogen, halogen, nitro or cyano, (4)

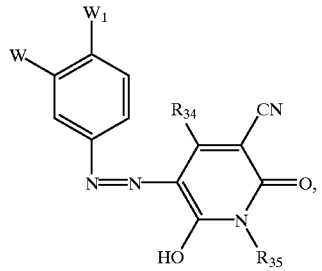

in which $R_{34}$ is $C_1$–$C_4$alkyl, $R_{35}$ is $C_1$–$C_4$alkyl which is unsubstituted or substituted by $C_1$–$C_4$alkoxy, and W is the radical —$COOCH_2CH_2OC_6H_5$ and $W_1$ is hydrogen or W is hydrogen and $W_1$ is —N═N—$C_6H_5$, (5)

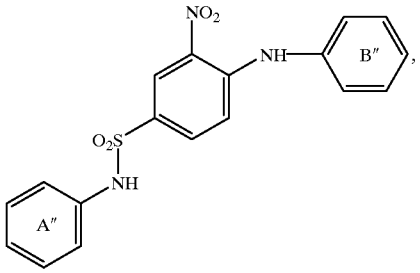

where the rings A" and B" are unsubstituted or substituted one or more times by halogen, (6)

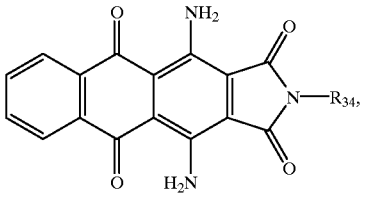

in which $R_{34}$ is $C_1$–$C_4$alkyl, which is unsubstituted or substituted by hydroxyl, $C_1$–$C_4$alkoxy or $C_1$–$C_4$alkoxy-$C_1$–$C_4$-alkoxy, (7)

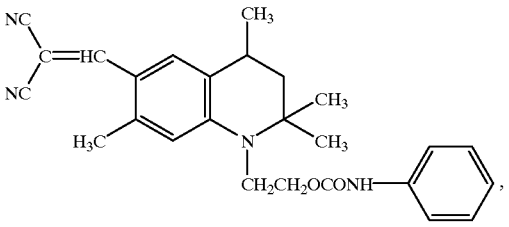

-continued (16)

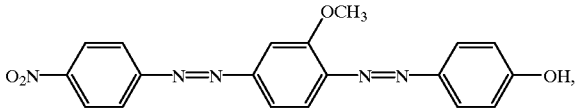

(20)

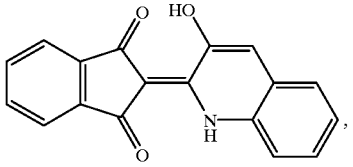

(21)

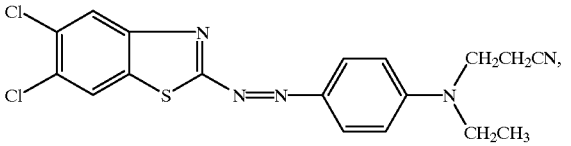

(22)

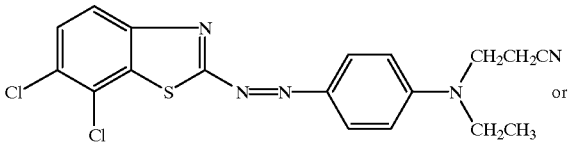

or (23)

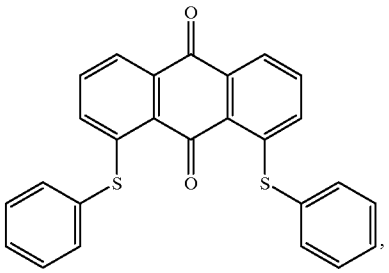

an anionic copolymer based on acrylic acid and styrene having a molecular weight of from 3,000 to 10,000 and etaine monohydrate.

2. A process according to claim 1, wherein a disperse dye of formula (1)

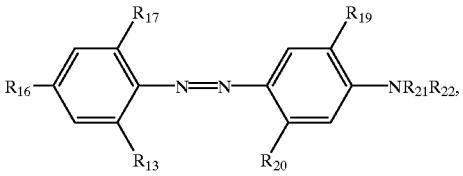

in which $R_{16}$ is halogen, nitro or cyano, $R_{17}$ is hydrogen, halogen or nitro, $R_{18}$ is halogen, $R_{19}$ is hydrogen, halogen $C_1$–$C_4$alkyl or $C_1$–$C_4$alkoxy, $R_{20}$ is hydrogen, halogen or acylamino, and $R_{21}$, and $R_{22}$ independently of one another are hydrogen or are $C_1$–$C_4$alkyl which is unsubstituted or substituted by hydroxyl, cyano, acetoxy or phenoxy, is used.

3. A process according to claim 1, wherein a disperse dye of formula (2)

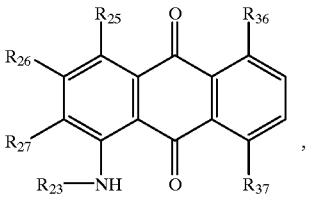

in which $R_{23}$ is hydrogen, phenyl or phenylsulfoxy, the benzene ring in phenyl and phenylsulfoxy being unsubstituted or substituted by $C_1$–$C_4$alkyl, sulfo or $C_1$–$C_4$alkylsulfo, $R_{25}$ is unsubstituted or $C_1$–$C_4$alkyl substituted amino or hydroxyl, $R_{26}$ is hydrogen or $C_1$–$C_4$alkoxy, $R_{27}$ is hydrogen or the radical —O—$C_6H_5$—$SO_2$—NH—$(CH_2)_3$—O—$C_2H_5$, $R_{36}$ is hydrogen, hydroxyl or nitro and $R_{37}$ is hydrogen, hydroxyl or nitro, is used.

4. A process according to claim 1, wherein the disperse dye of formula (8)

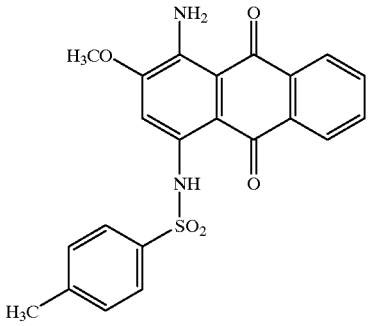

is used.

5. A process according to claim 1, wherein the disperse dye of formula (9)

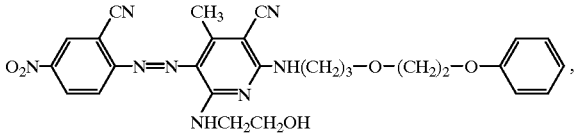

is used.

6. A process according to claim 1, wherein the disperse dye of formula (10)

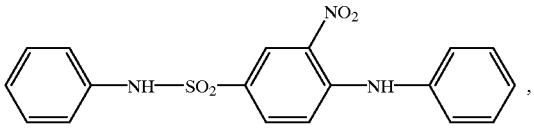

is used.

7. A process according to claim 1, wherein the disperse dye of formula (11)

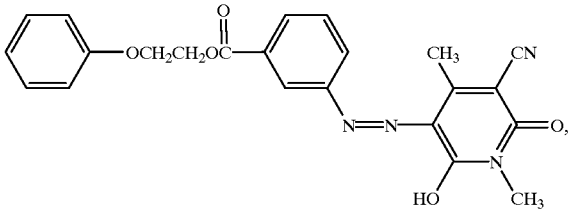

is used.

8. A process according to claim 1, wherein the disperse dye of formula (12)

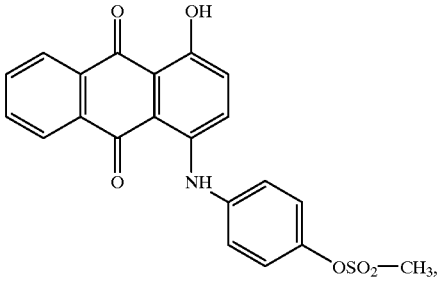

is used.

9. A process according to claim 1, wherein the disperse dye of formula (13)

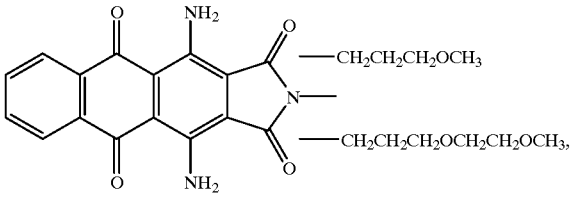

is used.

10. A process according to claim 1, wherein the disperse dye of formula (14)

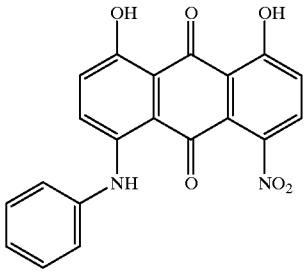

or

-continued (15)

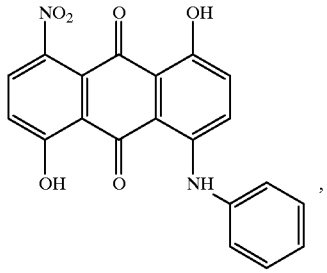

is used.

11. A textile fibre material printed by the ink-jet printing process with an aqueous printing ink comprising at least one disperse dye of the formula (1)

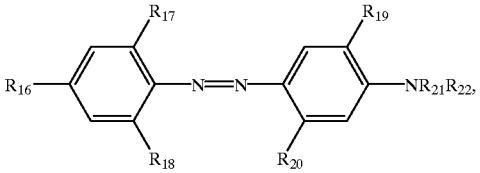

in which $R_{16}$ is halogen, nitro or cyano, $R_{17}$ is hydrogen, halogen, nitro or cyano, $R_{18}$ is halogen or cyano, $R_{19}$ is hydrogen, halogen $C_1$–$C_4$alkyl or $C_1$–$C_4$alkoxy, $R_{20}$ is hydrogen, halogen or acylamino, and $R_{21}$ and $R_{22}$ independently of one another are hydrogen or are $C_1$–$C_4$alkyl which is unsubstituted or substituted by hydroxyl, cyano, acetoxy or phenoxy, (2)

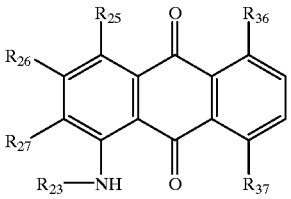

in which $R_{23}$ is hydrogen, phenyl or phenylsulfoxy, the benzene ring in phenyl and phenylsulfoxy being unsubstituted or substituted by $C_1$–$C_4$alkyl, sulfo or $C_1$–$C_4$alkylsulfo, $R_{25}$ is unsubstituted or $C_1$–$C_4$alkyl substituted amino or hydroxyl, $R_{26}$ is hydrogen or $C_1$–$C_4$alkoxy, $R_{27}$ is hydrogen or the radical —O—$C_6H_5$—$SO_2$—NH—$(CH_2)_3$—O—$C_2H_5$, $R_{36}$ is hydrogen, hydroxyl or nitro and $R_{37}$ is hydrogen, hydroxyl or nitro, (3)

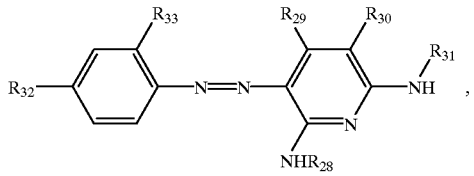

in which $R_{28}$ is $C_1$–$C_4$alkyl which is unsubstituted or substituted by hydroxyl, $R_{29}$ is $C_1$–$C_4$alkyl, $R_{30}$ is cyano, $R_{31}$ is the radical of the formula —$(CH_2)_3$—O—$(CH_2)_2$—O—$C_6H_5$, $R_{32}$ is halogen, nitro or cyano, and $R_{33}$ is hydrogen, halogen, nitro or cyano, (4)

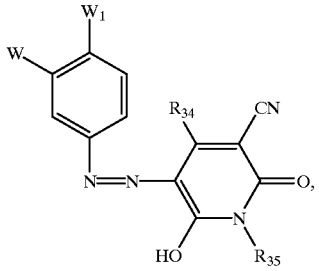

in which $R_{34}$ is $C_1$–$C_4$alkyl, $R_{35}$ is $C_1$–$C_4$alkyl which is unsubstituted or substituted by $C_1$–$C_4$alkoxy, and W is the radical —$COOCH_2CH_2OC_6H_5$ and $W_1$ is hydrogen or W is hydrogen and $W_1$ is —N=N-$C_6H_5$, (5)

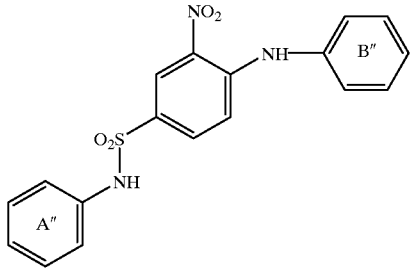

where the rings A" and B" are unsubstituted or substituted one or more times by halogen, (6)

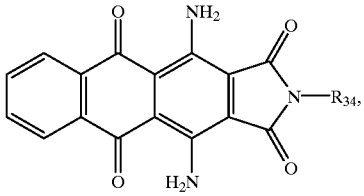

in which $R_{34}$ is $C_1$–$C_4$alkyl, which is unsubstituted or substituted by hydroxyl, $C_1$–$C_4$alkoxy or $C_1$–$C_4$alkoxy-$C_1$–$C_4$alkoxy, (7)
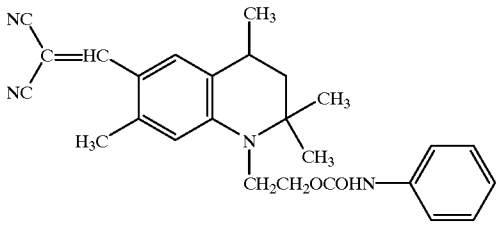
(16)
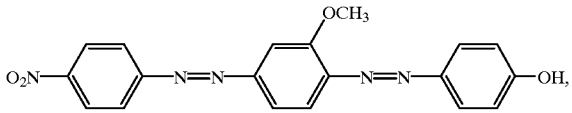
(20)
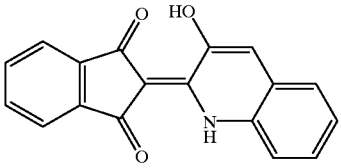
(21)
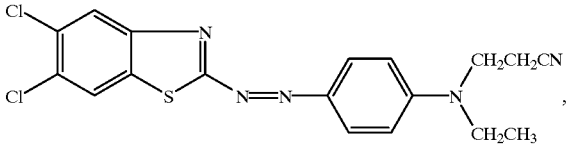
-continued
(22)
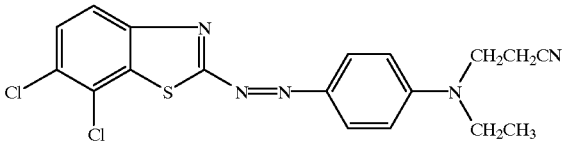
or
(23)
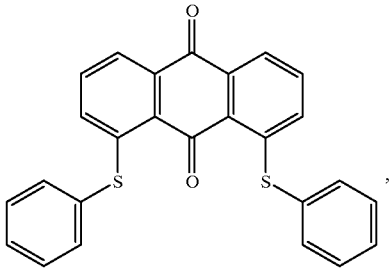
an anionic copolymer based on acrylic acid and styrene having a molecular weight of from 3,000 to 10,000 and betaine monohydrate.
* * * * *